United States Patent [19]

Delatorre

[11] 4,028,876

[45] June 14, 1977

[54] APPARATUS FOR VISUALLY INDICATING ELAPSED TIME BY A COLOR CHANGE

[75] Inventor: Jorge M. Delatorre, Leisure City, Fla.

[73] Assignee: Lawrence Peska Associates, Inc., New York, N.Y.

[22] Filed: Mar. 5, 1976

[21] Appl. No.: 664,307

[52] U.S. Cl. ..... 58/1 R; 116/114 AM

[51] Int. Cl.[2] ..... G04F 13/00

[58] Field of Search ..... 73/356, 358; 58/1 R; 116/114.5, 114 Y, 114 V, DIG. 41, 114 AM; 252/408; 23/253 TP

[56] References Cited

UNITED STATES PATENTS

| | | | |
|---|---|---|---|
| 2,552,477 | 5/1951 | Cole | 73/356 |
| 3,018,611 | 1/1962 | Biritz | 58/1 R |
| 3,059,474 | 10/1962 | Keller | 73/358 |
| 3,932,134 | 1/1976 | Fang | 73/356 |

*Primary Examiner*—S. Clement Swisher
*Assistant Examiner*—Denis E. Corr

[57] ABSTRACT

Apparatus for visually indicating elapsed time by a color change is disclosed comprising a first and second chromophoric compound that are combined with one another through a matrix which controls the rate of combination of the compounds so that a color body is produced by the reaction of the compounds over a period of time that may be adjustable from anywhere from about one to about thirty days. The device comprises a transparent container having a rupturable capsule therein in which the first composition is contained. A transparent matrix surrounding the second composition is also in the container. The device may be secured to a surface by means of a mechanical fastener or an adhesive layer.

7 Claims, 2 Drawing Figures

APPARATUS FOR VISUALLY INDICATING ELAPSED TIME BY A COLOR CHANGE

SUMMARY OF THE INVENTION

The present invention relates to apparatus for visually indicating elapsed time by a color change comprising a transparent flexible enclosed receptacle having a ruptureable sealed container therein and a first chromphoric compound in the container. A second chromophoric compound enclosed in a transparent matrix is also provided in the receptacle, the first compound and the second compound comprising reactants that form a color body when contacted with one another. The matrix is permeable by the first compound so that when the container is ruptured, the first compound permeates the matrix and reacts with the second compound to form the color body. The degree of permeability of the matrix is controlled to increase or decrease the time for complete reaction of all of the first compound with all of the second compound.

The first compound comprises a fluid in one embodiment such as a liquid and the matrix is permeable to the fluid. The second compound may be enclosed in an envelope of the matrix material or it may be microencapsulated and either placed in the receptacle.

In another embodiment the permeability of the matrix is adjusted by changing the porosity of the matrix or the thickness thereof. Where the matrix comprises a plastic material the permeability may be adjusted by changing the thickness of the walls of the plastic matrix or by changing the cross-linking of the plastic. Either a thermoplastic or a thermo setting plastic material may be used in this respect. Further, the permeability of the matrix which is a plastic material may be changed by adjusting the molecular weight of the plastic.

DETAILED DESCRIPTION

There is a need in the art for a label that changes color with time to indicate the amount of time a product has been in use, in transit or in storage.

A change in the condition of products can be measured by devices known in the prior art however, such devices rely on a change of temperature to indicate the spoilage of a product or a change of humidity of the product, both methods being unsuitable to articles of manufacture, compositions or compounds which will not necessarily be exposed to extremes of temperature or humidity. These devices of the prior art are disclosed in U.S. Pat. Nos. 3,568,627 Selinger, et al; 3,545,400 Smith; 3,118,774 Davidson et al; 3,059,474 Keller et al; 3,047,405 Lanier; 2,951,461 Lockwood; 2,826,073 Huych et al; and 2,560,537 Andersen.

It is therefore an object of the present invention to overcome these and other difficulties encountered in the prior art.

It is a further object of the present invention to provide a device for visually indicating elapsed time which is not dependent upon ambient temperature changes or humidity changes.

It is a further object of the present invention to provide a device to visually indicate elapsed time by a color change.

These and other objects have been achieved by the present invention as will become apparent by reference to the disclosure and claims that follow as well as the appended drawing.

Figure 1:
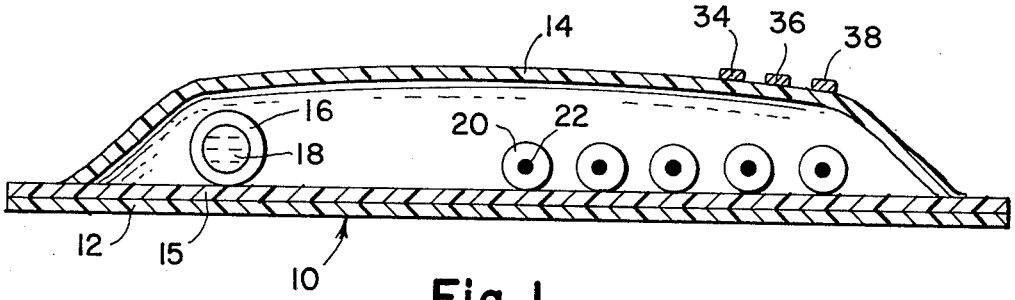
FIG. 1 is a side elevation in section of a device for visually indicating elapsed time by a color change according to one embodiment of the present invention.

A receptacle is illustrated in FIG. 1 comprising an envelope 14 which is made of a flexible transparent plastic material that is sealed at the edges thereof to a substrate 15. A ruptureable container 16 having a first chromophoric compound 18 therein is contained within the receptacle and a matrix material 20 surrounding a second chromophoric compound 22 is also placed within the container. This assembly comprises the device 10 for visually indicating elapsed time by a color change, a similar construction 100 being illustrated in FIG. 2 for the same purpose.

The substrate 15 may be made of any material either rigid or flexible metallic or non-metallic such as aluminum foil, or a thermoplastic film such as Mylar (trademark), a poly(ethylene glycol terephathlate), substrate 15 being chosen to be substantially non-permeable or non-susceptible to attack by the first chromophoric compound 18 and the second chromophoric compound 22. Film 14 comprises a transparent flexible thermoplastic film so that any color change occuring within the envelope or container 10 may be readily seen. Again, Mylar or equivalent thermoplastic films such as acrylic polymer films may be used as well as polyolefin films including polyethylene, polypropylene and the co-polymers thereof with acrylic acid acrylic esters and methacrylic acid and methacrylic esters, vinyl acetate and other vinyl esters and the art known equivalents thereof. Sealed container 16 may be made of the same material as layer 14 however is thin enough so that when pressure is applied to container 16 through layer 14, container 16 will rupture and the contents thereof comprising chromophoric compound 18 will be released into the space provided between layers 14 and 15. Chromophoric compound 18 preferably is a fluid such as a liquid. The matrix material 20 is selected to be permeable by chromophoric compound 18, matrix material 20 being made of a thermoplastic material such as gelatin, carboxymethyl cellulose or porous thermoplastic films such as the film employed in capsule 16 or layer 14, the film being made porous by irradiation with highly concentrated energy beams such as lasers, X-ray radiation or gamma radiation, these films also being made porous by mixing solvent soluble or water soluble fillers therein during the manufacture thereof and after forming, leaching the fillers with a solvent such as water to remove the filler and leave a void, or porous opening which is fluid permeable. The permeability of the matrix 20 may be adjusted to either increase or decrease the time for the passage of first chromophoric compound 18 into contact with second chromophoric compound 22, the adjustment of the permeability being achieved by increasing or decreasing the thickness of the matrix 20, increasing or decreasing the porosity of the matrix, and where the matrix is a plastic material such as thermoplastic or a thermo setting material, increasing or decreasing the cross-linking of the plastic polymer and further by either increasing or decreasing the molecular weight of the plastic polymer.

In one embodiment, capsule of container 16 is a thin walled low molecular weight polyethylene capsule containing water, substrate 15 comprises either aluminum foil or Mylar and layer 14 sealed to substrate 15 comprises Mylar. Matrix 20 comprises a gelatine matrix which may be hardened or cross-linked by subjecting the gelatine to reaction with formaldehyde, the degree or hardening or cross-linking depending on the concentration and length of time of treatment with formaldehyde. Gelatine is selected in this instance since it is permeably by water which is employed as a first chromophoric compound 18. Second chromophoric compound 22 is selected to give a color reaction with water and may comprise either anhydrous copper sulfate which when contacted with water permeating through matrix 20 will turn blue of may comprise filter paper particles saturated with a solution of potassium lead iodide in acetone which becomes yellow upon exposure to minute amounts of water.

Alternately, a chromophoric compound 18 may comprise a solution of potassium ferrocyanide and second chromophoric compound 22 may comprise particles of copper the reaction between the potassium ferrocyanide and copper giving a reddish color. This color development will occur gradually or over a period of time depending upon the porosity of the matrix which may be changed or adjusted as previously described. Additionally, first chromophoric compound 18 may comprise a phenolthalein solution and the second chromophoric compound may comprise crystals of an organic acid such as oxalic acid, the combination of phenolthalein and oxalic acid giving a reddish color. In one embodiment the encapsulated chromophoric compound 22 may comprise micro-encapsulated particles of compound 22 enveloped in matrix 20, the process of micro-encapsulation being well known it the art.

An adhesive layer 12 is provided on the bottom of substrate 15 for adhering the apparatus of the present invention to a surface, mechanical fasteners also being within the scope of the present invention, such mechanical fasteners comprising either hooks, or a Velcro (trademark) surface attached to the device 10.

In another embodiment a receptacle 100 is employed having a substrate 25, an outer layer 26 sealed to substrate 25 and an adhesive layer 24 being positioned beneath substrate 25. A container 28 which is rupture-able is provided having a first chromophoric compound 30 therein, a second chromophoric compound 33 also being provided within the envelope formed between film 26 and substrate 25. The second compound 33 is contained within a matrix 32, the film, matrix, chromophoric compounds and ruptureable filled containers all being identical to the counterparts thereof in FIG. 1 with respect to the materials from which these components are fabricated, chromophoric compound 33 being provided as a layer and not a particulate material.

Figure 2:
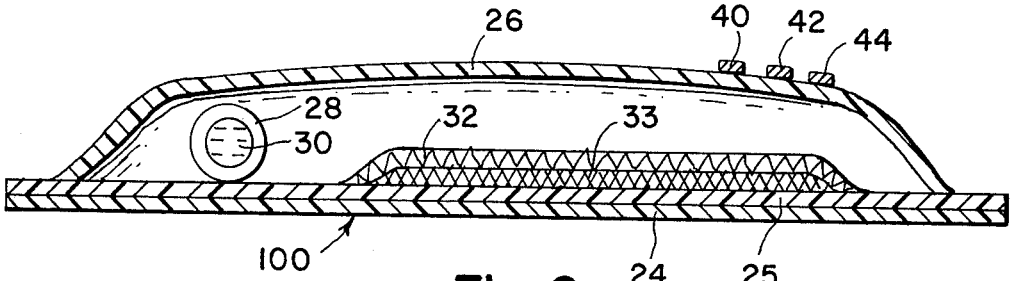
FIG. 2 is a side elevation in section illustrating a device for visually indicating elapsed time by a color change according to one embodiment of the present invention.

In use the device illustrated either in FIG. 1 or FIG. 2 is attached to a surface through adhesive layer 12 or 24 and ruptureable sealed container 16 or 28 is broken by applying pressure through film 14 or 26 against container 16 or 28 respectively. The first chromophoric compound is released after the ruptureable container is broken and contacts the matrix surrounding the second chromophoric compound. Depending upon the permeability of the matrix, the first chromophoric compound over a period of time anywhere from about one to about thirty days will permeate or pass through the matrix, and contact the second chromophoric compound surrounded by the matrix. The combination of the first and second chromophoric compounds form a color body which intensifies in color as greater quantities of the first chromophoric compound pass through the matrix and combine with the second chromophoric compound. When the device of the present invention is placed wither on a pharmaceutical container or on a package or article of manufacture that is to be either transported or stored, the ruptureable container is broken and as the color develops within the device, it can be determined by a quick visual inspection whether the article to which the device is attached has been consumed within a fixed time or has been transported or stored for a fixed period of time from the time of rupturing the container by the intensity of the color developed within the device, slight color development indicating the full time period has not elapsed, intense coloration indicating that the recommended time has transpired. In order to determine if such color intensities have been partially or fully developed, a color comparator comprising a plurality of colored strips 34, 36 and 38 employed on the device 10 and strips 40, 42 and 44 employed on the device 100 are employed whereby each strip corresponds to the color body formed by the combination of the first and second chromophoric compounds however the strips increase in tone or color quality until the last strip corresponds in color to the fully developed tone resulting from the complete reaction of the first and second chromphoric compounds to form the color body.

It has been found also that by employing a material in combination with the second chromophoric compound that is highly absorbant for the first chromophoric compound, the rate of permeation of the first compound to the matrix can be speeded up. for example, the use of potassium lead iodide on filter paper increases the rate of permeation of the first compound through the matrix into the second compound. The filter paper acts in this instance as a sorping material for the first chromophoric compound.

In a further embodiment of the present invention, layers of color forming bodies may be employed to produce a mix of colors which will indicate the lapsed time. If particulate anhydrous copper sulfate is laid down as a first layer of chromophoric compound in the device illustrated in FIG. 2 and particulate filter paper coated with potassium lead iodide is placed over the copper sulfate as an uppermost layer, water permeating through matrix 32 will color the first layer yellow indicating that the full time period has not elapsed whereas the reaction continues and the water permeates downward through the potassium lead iodide into the copper sulfate a bluish coloration is developed in the reaction of water and copper sulfate, the mixture of blue and yellow turning the overall mixture of potassium lead iodide and anhydrous copper sulfate in the matrix 32 from yellow to green.

Although the invention has been described by reference to some embodiments it is not intended that the novel device for indicating elapsed time by a color change is to be limited thereby but that modifications thereof are intended to be included as falling within the broad scope and spirit of the foregoing disclosure, the following claims and the appended drawing.

What is claimed is:

1. Apparatus for visual indication of elapsed time by a color change comprising a transparent flexible enclosed receptacle means having a ruptureable sealed container therein, a first fluid chromophoric compound in said container, second chromophoric compound enclosed in a transparent organic film matrix within said receptacle, said first compound and said second compound comprising reactants that form a color body when contacted with one another, said organic film matrix being permeable by said first compound.

2. The device of claim 1 where said organic film matrix comprises a plastic composition.

3. The device of claim 1 where said second compound is combined with a material for the sorption of said first compound.

4. The device of claim 1 further comprising means for securing said receptacle to a surface.

5. The device of claim 4 where said means for securing said receptacle to a surface comprises an adhesive.

6. Apparatus for visual indication of elapsed time by a color change comprising a transparent flexible enclosed receptacle means having a ruptureable sealed container therein, a first chromophoric compound in said container, second chromophoric compound enclosed in a transparent matrix within said receptacle, said first compound and said second compound comprising reactants that form a color body when contacted with one another, said matrix being permeable by said first compound said second compound being micro-encapsulated in said matrix.

7. Apparatus for visual indication of elapsed time by a color change comprising a transparent flexible enclosed receptacle means having a ruptureable sealed container therein, a first chromophoric compound in said container, second chromophoric compound enclosed in a transparent matrix within said receptacle, said first compound and said compound comprising reactants that form a color body when contacted with one another, said matrix being permeable by said first compound, a plurality of color comparator means on the exterior of said receptacle corresponding in color to the color body produced by the combination of the first and second chromophoric compound, said color comparators increasing in tone from a light color to the color represented by the complete reaction of said first and second chromophoric compounds to form the color body.

* * * * *